US007658653B2

(12) United States Patent
Diekmann et al.

(10) Patent No.: US 7,658,653 B2
(45) Date of Patent: Feb. 9, 2010

(54) TERMINAL BLOCK WITH PLUG-IN MODULE

(75) Inventors: Joerg Diekmann, Oerlinghausen (DE); Torsten Diekmann, Leopoldshöhe (DE); Michael Lenschen, Detmold (DE); Joern Buhrke, Lübbecke (DE)

(73) Assignee: Weidmuller Interface GmbH & Co. KG, Detmold (DE)

( * ) Notice: Subject to any disclaimer, the term of this patent is extended or adjusted under 35 U.S.C. 154(b) by 0 days.

(21) Appl. No.: 12/082,119

(22) Filed: Apr. 9, 2008

(65) Prior Publication Data

US 2008/0261426 A1 Oct. 23, 2008

(30) Foreign Application Priority Data

Apr. 12, 2007 (DE) ..... 20 2007 005 373 U

(51) Int. Cl.
*H01R 9/22* (2006.01)

(52) U.S. Cl. ..... 439/715

(58) Field of Classification Search ..... 439/715, 439/716, 709, 922, 189
See application file for complete search history.

(56) References Cited

U.S. PATENT DOCUMENTS 3,602,586 A * 8/1971 Bartl et al. ..... 352/243
4,687,270 A * 8/1987 Plyler et al. ..... 439/350
4,758,186 A * 7/1988 Barriuso et al. ..... 439/723
4,826,439 A * 5/1989 Lau ..... 439/56
4,846,733 A * 7/1989 Baisz et al. ..... 439/620.33
4,929,186 A * 5/1990 Steinkuhle et al. ..... 439/78
5,049,094 A * 9/1991 Heng et al. ..... 439/716
5,090,922 A * 2/1992 Rymer et al. ..... 439/716
5,145,417 A * 9/1992 Honkomp et al. ..... 439/685
5,208,525 A * 5/1993 Lopic et al. ..... 320/112
5,224,881 A * 7/1993 Lejuste et al. ..... 439/709
5,299,957 A * 4/1994 Schaeffer ..... 439/712
5,318,461 A * 6/1994 Frikkee et al. ..... 439/715
5,356,303 A * 10/1994 Shibata et al. ..... 439/198
5,411,417 A * 5/1995 Horn et al. ..... 439/709
5,588,881 A * 12/1996 Eggert et al. ..... 439/709
5,658,172 A * 8/1997 Schmidt et al. ..... 439/716

(Continued)

FOREIGN PATENT DOCUMENTS

DE 102 54 871 A1 1/2004

(Continued)

*Primary Examiner*—T C Patel
*Assistant Examiner*—Vladimir Imas
(74) *Attorney, Agent, or Firm*—Lawrence E. Laubscher, Sr.; Lawrence E. Laubscher, Jr.

(57) ABSTRACT

A connector arrangement includes a universal terminal block having a body containing a chamber in which is removably mounted one of a plurality of function control modules as used in commercial, industrial and residential installations, wherein a pair of module contacts on the module are brought into electrical engagement with a pair of stationary contacts mounted in the chamber, thereby to connect the module to a pair of external insulated conductors via bus bars and terminals contained in the terminal block body. Various types of function control modules may be used with a single universal terminal block. The modules may include locking devices for locking the module to the universal terminal block. The terminal block includes mounting feet on the side thereof remote from the chamber, whereby selective modules may be substituted for one another when the terminal block is mounted on a support rail.

9 Claims, 17 Drawing Sheets

U.S. PATENT DOCUMENTS

| | | | | |
|---|---|---|---|---|
| 5,724,421 | A * | 3/1998 | Tuvy et al. | 379/413.02 |
| 5,788,519 | A * | 8/1998 | Stern | 439/189 |
| 5,803,772 | A * | 9/1998 | Muller et al. | 439/716 |
| 5,915,975 | A * | 6/1999 | McGrath | 439/74 |
| 6,057,608 | A * | 5/2000 | Bailey et al. | 307/43 |
| 6,241,541 | B1 * | 6/2001 | Hida | 439/188 |
| 6,241,561 | B1 * | 6/2001 | Zebermann et al. | 439/716 |
| 6,257,922 | B1 * | 7/2001 | Shinozaki | 439/489 |
| 6,257,938 | B1 * | 7/2001 | Day et al. | 439/723 |
| 6,273,746 | B1 * | 8/2001 | Seko et al. | 439/417 |
| 6,291,767 | B1 * | 9/2001 | Beecher et al. | 174/50 |
| 6,299,467 | B1 * | 10/2001 | Chien | 439/188 |
| 6,814,627 | B2 * | 11/2004 | Yamamoto et al. | 439/701 |
| 6,840,819 | B2 * | 1/2005 | Bet et al. | 439/716 |
| 6,848,951 | B1 * | 2/2005 | Bechaz et al. | 439/716 |
| 6,935,893 | B1 * | 8/2005 | Flowers et al. | 439/595 |
| 6,940,021 | B2 * | 9/2005 | Pohl et al. | 174/137 R |
| 6,984,147 | B2 * | 1/2006 | Tricaud et al. | 439/509 |
| 7,109,833 | B1 * | 9/2006 | Pohl | 335/59 |
| 7,110,534 | B1 * | 9/2006 | Mullaney et al. | 379/428.01 |
| 7,160,132 | B2 * | 1/2007 | Phillips et al. | 439/341 |
| 7,179,137 | B1 * | 2/2007 | Quendt et al. | 439/828 |
| 7,192,316 | B1 * | 3/2007 | Pollmann | 439/716 |
| 7,273,387 | B2 * | 9/2007 | Shimirak | 439/417 |
| 7,335,054 | B2 * | 2/2008 | Nakazawa et al. | 439/511 |
| 7,364,449 | B2 * | 4/2008 | Makino | 439/212 |
| 2005/0221654 | A1 * | 10/2005 | Phillips et al. | 439/347 |
| 2007/0123075 | A1 * | 5/2007 | Insalaco et al. | 439/120 |
| 2007/0161270 | A1 * | 7/2007 | Insalaco et al. | 439/120 |
| 2007/0281520 | A1 * | 12/2007 | Insalaco et al. | 439/120 |

FOREIGN PATENT DOCUMENTS

| | | | |
|---|---|---|---|
| DE | 20 2004 006 227 | U1 | 10/2004 |
| DE | 10 2004 045 889 | A1 | 6/2005 |
| DE | 10 2005 005 914 | A1 | 8/2006 |
| EP | 0 899 820 | | 8/2004 |
| WO | WO 95/12905 | | 5/1995 |

* cited by examiner

Fig. 11a
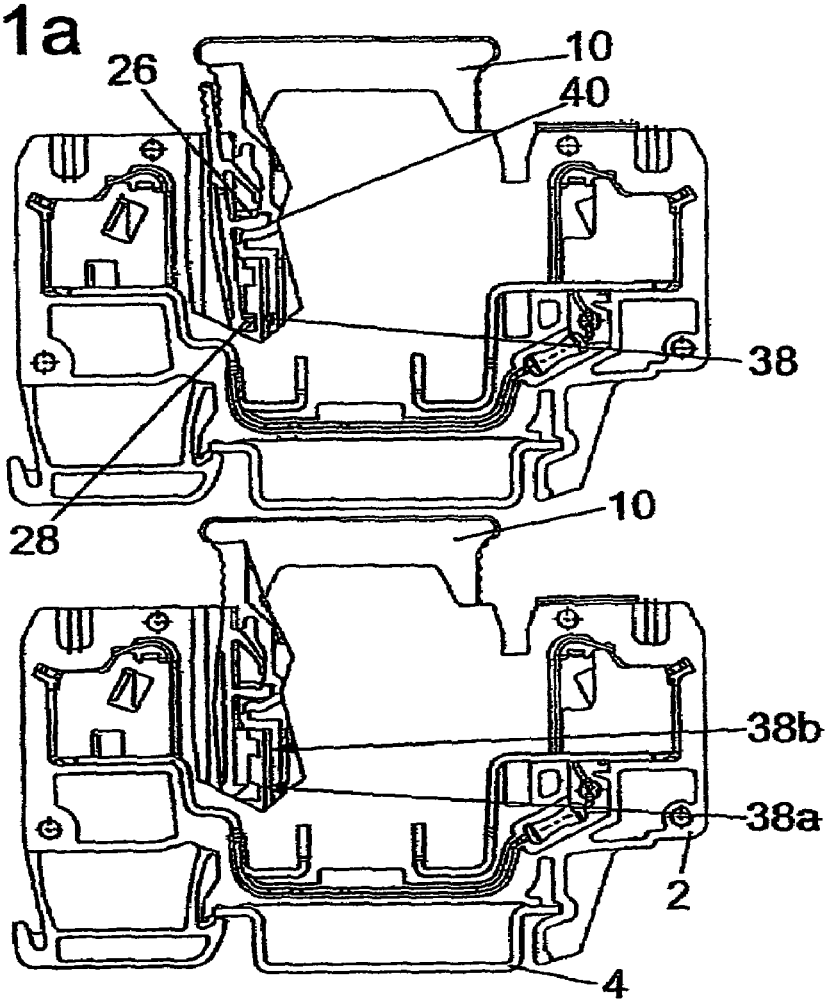
Fig. 11b
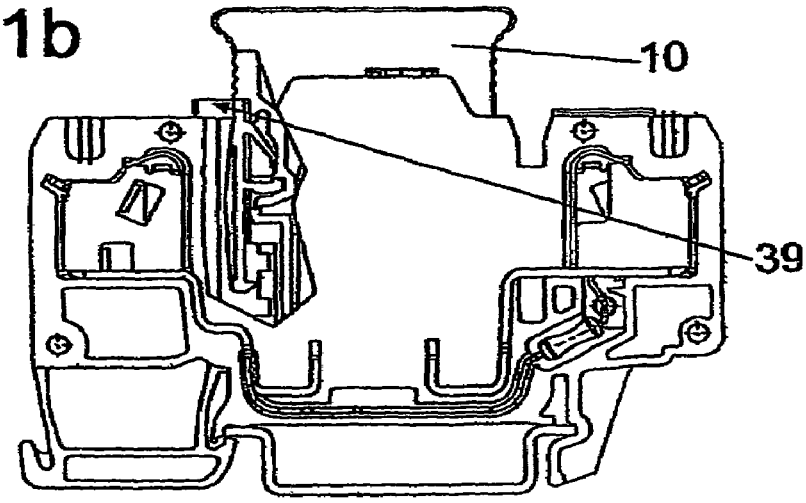
Fig. 11c

TERMINAL BLOCK WITH PLUG-IN MODULE

BACKGROUND OF THE INVENTION

1. Field of the Invention

A connector arrangement includes a universal terminal block having a body containing a chamber in which is removably mounted one of a plurality of function control or condition-sensing modules as used in commercial, industrial and residential installations, wherein a pair of module contacts on the module are brought into electrical engagement with a pair of stationary contacts mounted in the chamber, thereby to connect the module to a pair of external insulated conductors via bus bars and terminals contained in the terminal block body.

2. Description of Related Art

It is known that one can lock upon housing bases of terminal blocks that can be locked upon mounting rails, building blocks that can contain, for example, fuses or relay building blocks. This kind of state of the art is displayed in EP 0 899 820 A2 or DE 20 2004 006 227 U1. In doing so, function building blocks and housing bases as a rule are so fit in with each other that a certain function building block can be locked upon only a specific housing base. As a result, a terminal block maker must typically maintain in his assortment the most varied housing bases for different practical purposes.

The following are also cited regarding the state of the art: DE 10 2004 045 889 A1, DE 102 54 871 A1, DE 10 2005 005 914 and WO 95/12 905 A1.

SUMMARY OF THE INVENTION

Accordingly, a primary object of the present invention is to provide a connector arrangement including a universal terminal block having a body containing a chamber in which is removably mounted one of a plurality of different function control or condition sensing modules as used in commercial, industrial and residential installations, wherein a pair of module contacts on the module are brought into electrical engagement with a pair of stationary contacts mounted in the chamber, thereby to connect the module to a pair of external insulated conductors via bus bars and terminals contained in the terminal block body. Various types of function control modules may be used with a single universal terminal block.

According to another object of the invention, the modules may include locking means for locking the module to the universal terminal block. The terminal block includes mounting feet on the side thereof remote from the chamber, whereby selective modules may be substituted for one another when the terminal block is mounted on a support rail.

The invention creates a terminal block system with at least one housing body that has at least one or several connecting devices for conductors as well as a recess, in particular, a receiving chamber for a function control module that can be inserted in the chamber, whereby the module system has a plurality—at least three—of function modules performing different functions and/or geometry, which in each case can be inserted into the recess and which can there contact at least one or several contacts and can preferably be locked there.

In this way, one can in each case use or render usable a universal terminal block body—in this case, called basic body—for many different function control modules, something that reduces the inventory that must be kept and something that simplifies system planning and design.

BRIEF DESCRIPTION OF THE DRAWINGS

Other objects and advantages of the invention will become apparent from a study of the following specification, when viewed in the light of the accompanying drawing, in which:

FIGS. 11*a*-11*c* illustrate the manner in which the module is retained in two intermediate inserted positions;

DETAILED DESCRIPTION OF THE INVENTION

Figure 1A:
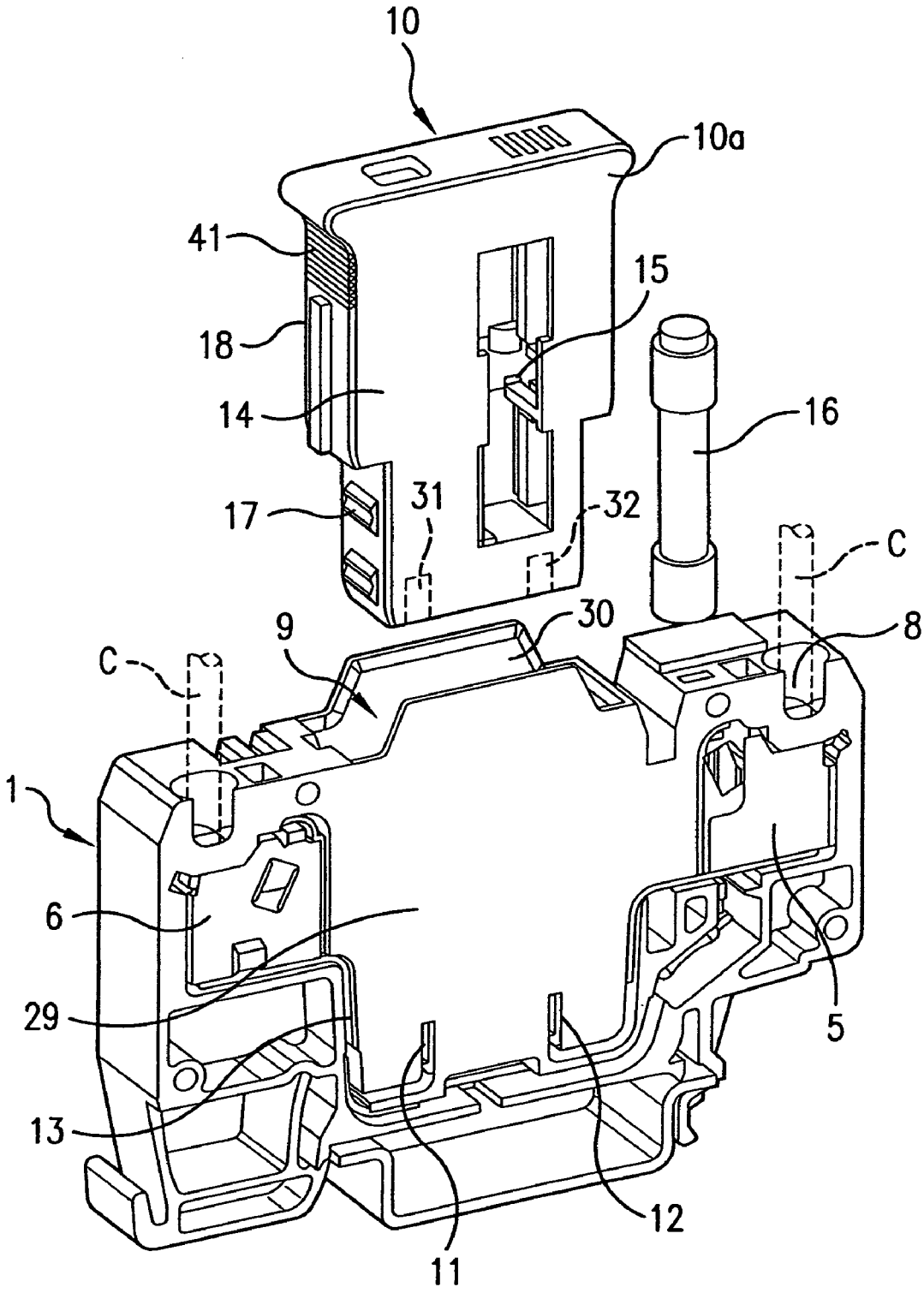
FIGS. 1*a* and 1*b* are perspective views of the universal terminal block of the present invention with a first function control module in the separated and completely inserted positions, respectively.
Figure 1B:
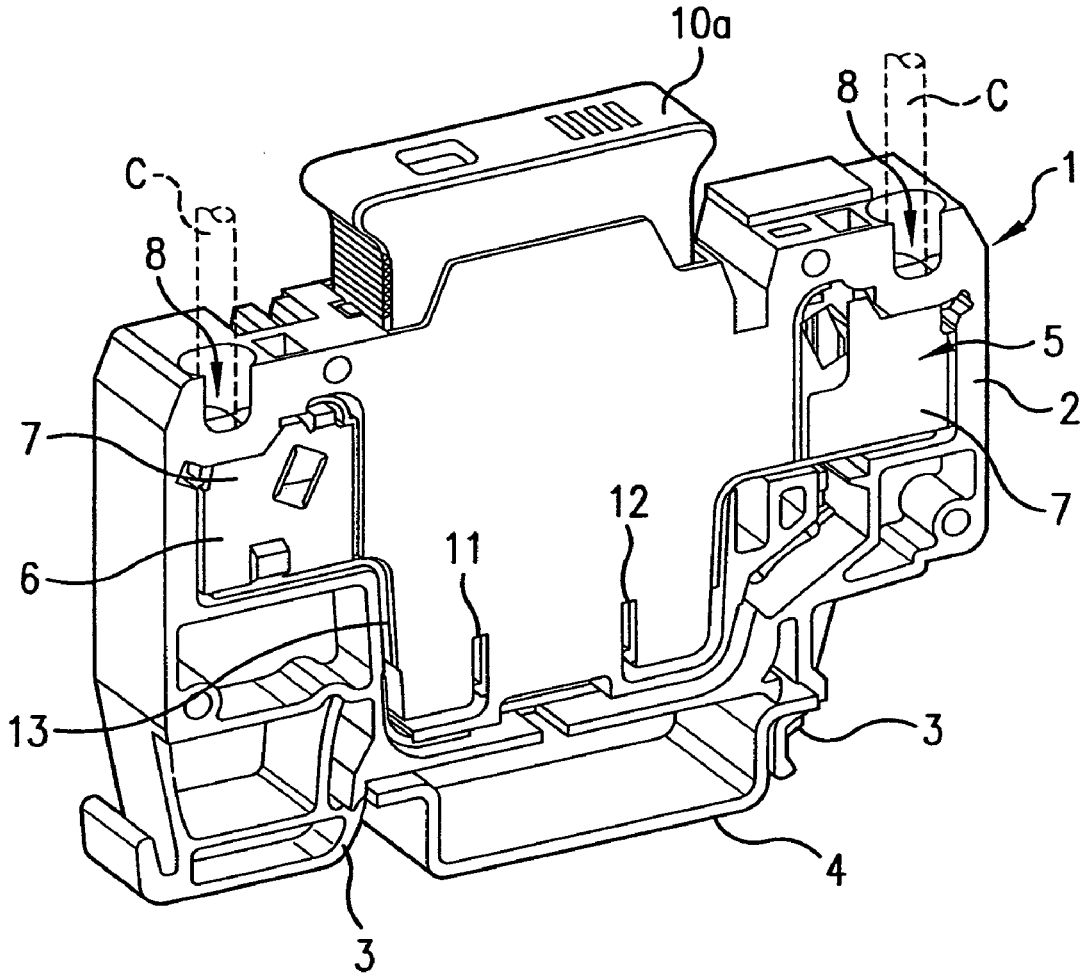
Figure 7:
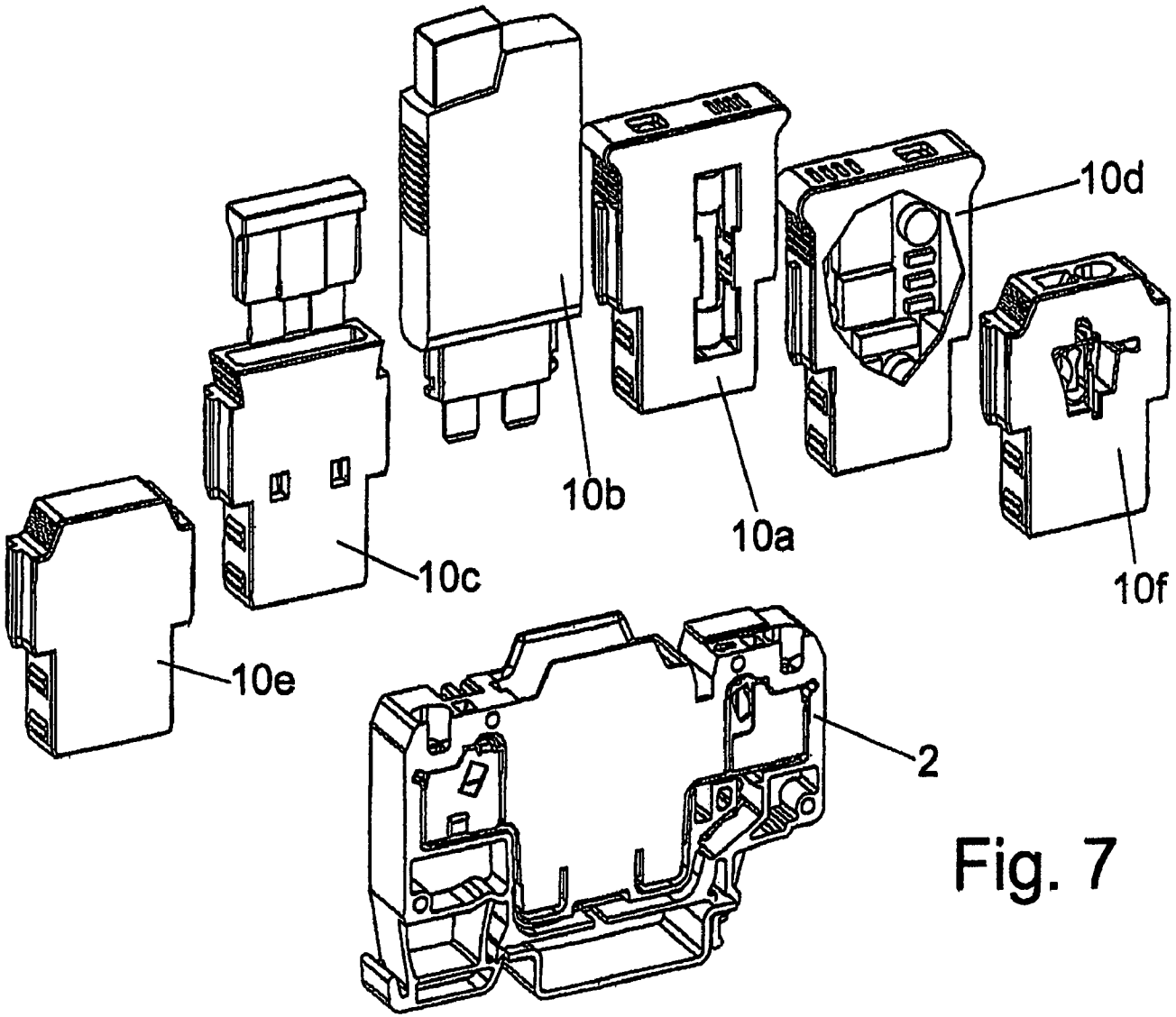
FIG. 7 is a perspective view of the universal terminal block with the six variations of modules that can be used therewith.

FIG. 1 shows a terminal block 1 of a terminal block system, which is illustrated by way of a general overview in FIG. 7.

Terminal block 1 has a housing body 2 that is made of insulating material that can be mounted upon a mounting rail 4 by means of catch feet 3 and which can be arrested or locked there. At least two or more terminal connection devices 5, 6 are arranged in housing body 2 made of insulation material for the connection of a pair of external insulated conductors C. Connection devices 5, 6 in this case are designed by way of example as push-in terminals by a known direct plug-in technique, which has a compression spring (to be recognized here only by way of indication), plus a terminal cage 7, whereby the bare ends of the conductors can be inserted into the connection devices via openings 8 contained in the housing base 2.

Housing body 2 has at least one chamber 9 for receiving one of a plurality of function control modules 10, which, according to FIGS. 1 to 6 or 7, are designed in the most different manner. Chamber 9 is in this case made in the middle between the two connection devices 5 and directly above the mounting rail 4 in the housing base 2. Preferably, chamber 9 defines a pair of thin longitudinal side walls 29, 30 formed of insulating material and which extend normal to the axis of the mounting rail 4. The chambers 9 extend essentially almost up to the lower edge of the housing body 2 on the mounting rail 4.

Into chamber 9 protrude in this case two contacts 11, 12 that are made for contacting in accordance with corresponding contacts 31 and 32 on the function control modules 10. Contacts 11, 12 are connected with the connection terminals 5 via bus bars 13.

According to the invention, it is now possible to insert the most varied and different types of function control modules 10 into the chamber or recess 9. For instance, FIG. 1 shows a first function control module 10*a* that has an insulation body 14 with a lateral seat 15 for a fuse 16. Insulation body 14 is provided with catch projections 17 that are made for engagement in correspondingly shaped catch recesses contained in chamber 9.

On each end, the insulation body has a guide rib 18 that serves as a guide and that is designed for engagement in a corresponding vertical groove contained in the adjacent side wall of the chamber 9. The housing or the insulation body 14 of the function control module 10 is made in a stepped fashion.

It is quite conceivable according to the manner shown in FIG. 1 to provide several function blocks 10*a* with differently dimensioned fuse holders for differently dimensioned fuses (5×20.5×25, 6.35×32) (not illustrated). The function control module 10*a* of FIG. 1*a* that acts as a fuse holder is normally locked in the lowermost position. However, an intermediate position may be provided (for purposes of separation).

Figures 2A, 2B:
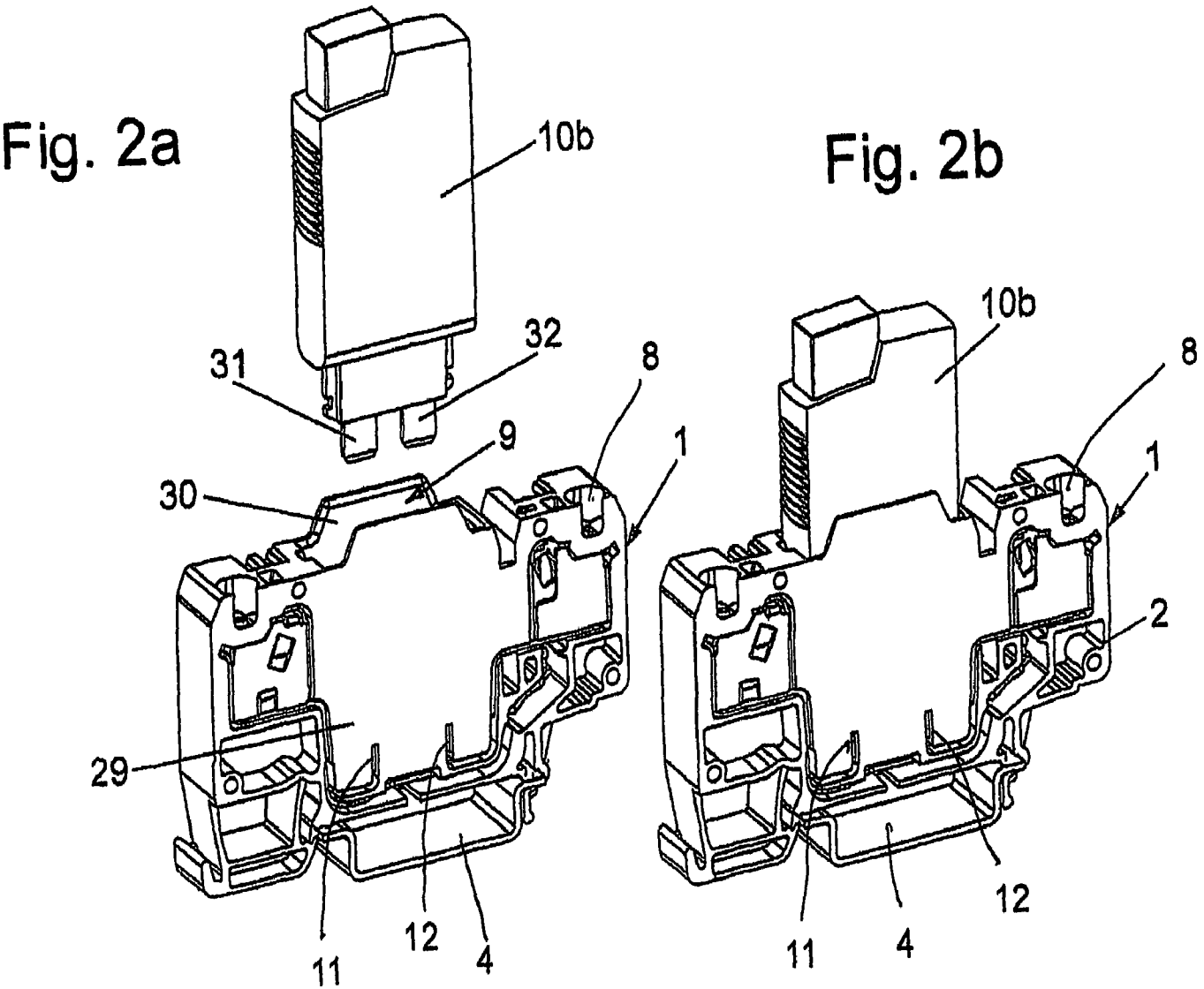
FIGS. 2*a* and 2*b* are perspective views of the universal terminal block with a second embodiment of the function control module in the separated and completely inserted positions, respectively.

According to FIGS. 2*a* and 2*b*, the function control module 10*b* is made as a pluggable automatic fuse such as it is, for example, readily available in commerce. It can be used for various automats for the most varied nominal currents. The fuse automat is also locked in the lowermost position. There its contacts 31, 32 contact the stationary contacts 11, 12 mounted in the recess 9. Again one can provide an intermediate position for purposes of separation.

Figures 3A, 3B:
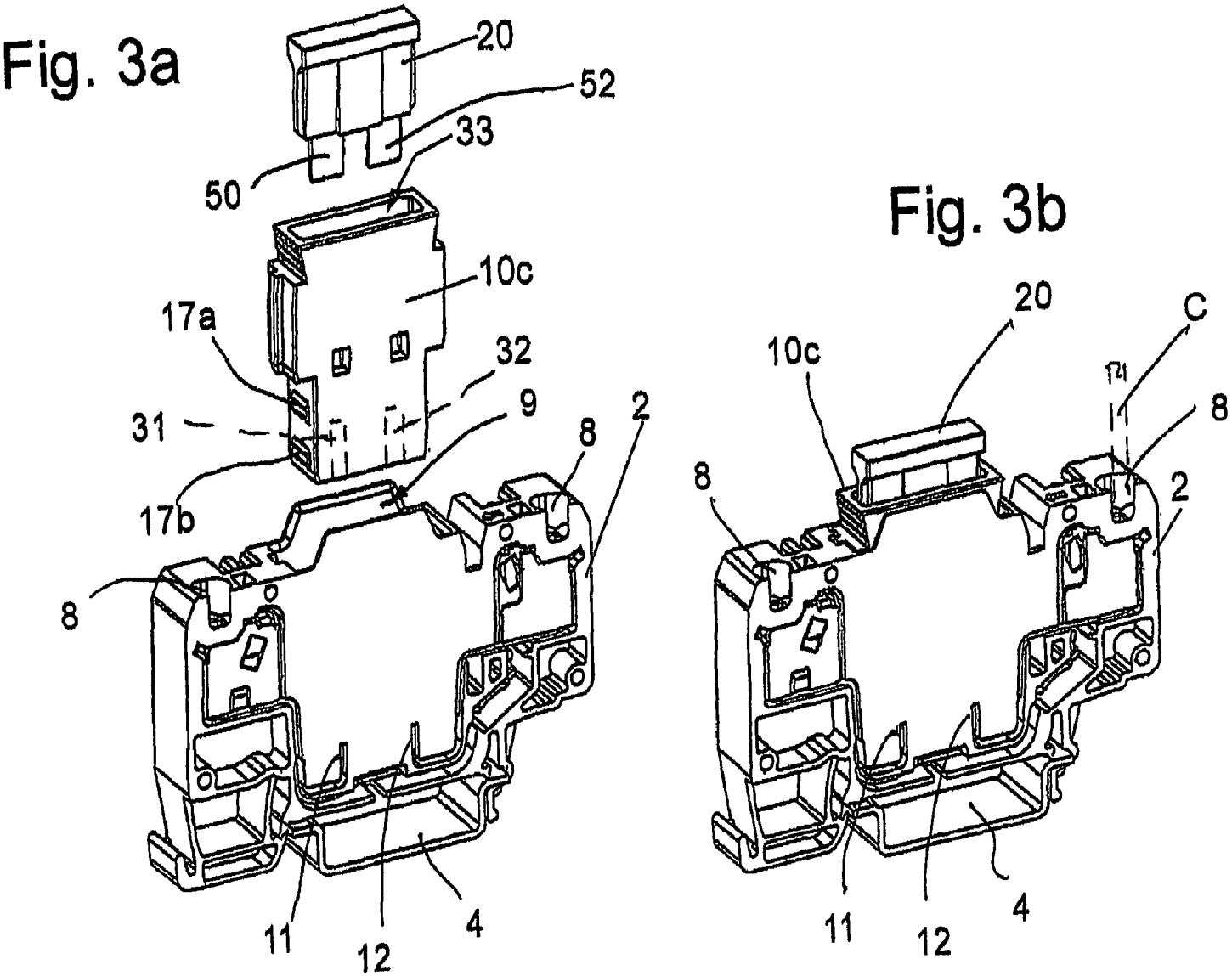
FIGS. 3*a* and 3*b* are perspective views of the universal terminal block with a third embodiment of the function control module in the separated and completely inserted positions, respectively.

FIGS. 3*a* and 3*b* illustrate a function control module block 10*c* that, in turn, is made as a pluggable automatic fuse with a seat 33 for flat fuses (especially motor vehicle fuses) 20. The most varied flat fuses can be supplied for different nominal currents. This function control module 10*c* is also arrested in the lower position. Again, one can provide an intermediate position for purposes of separation (not shown).

Figure 4B:
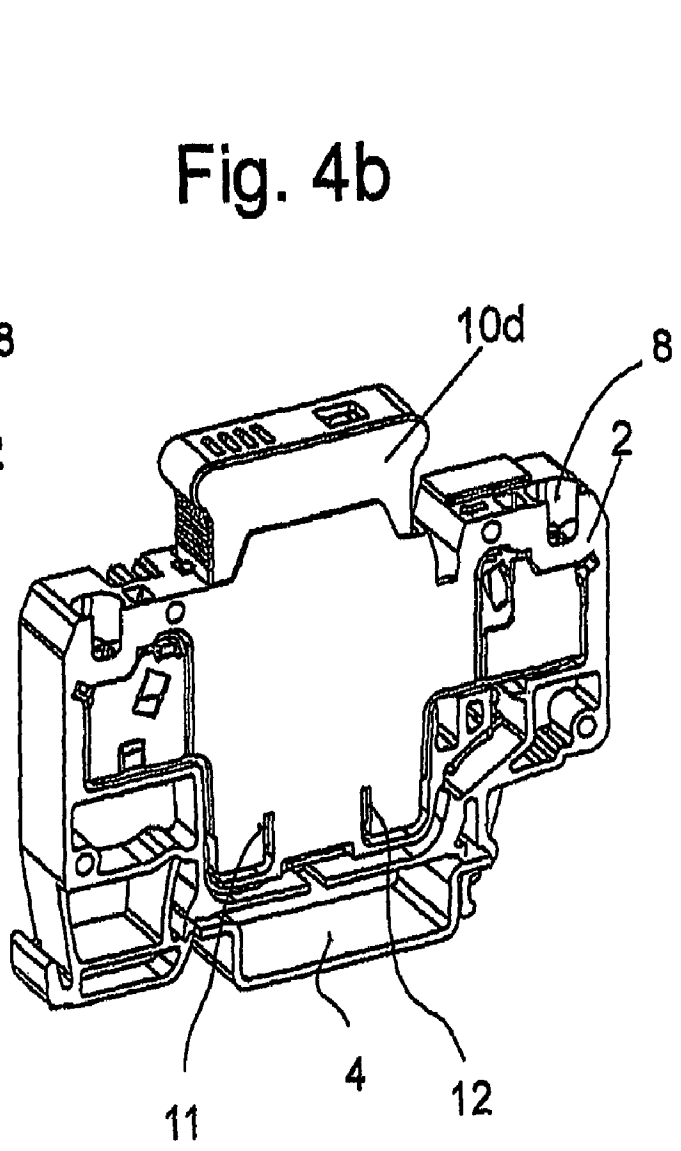
FIGS. 4*a* and 4*b* are perspective views of the universal terminal block with a fourth embodiment of the function control module in the separated and completely inserted positions, respectively.
Figure 4A:
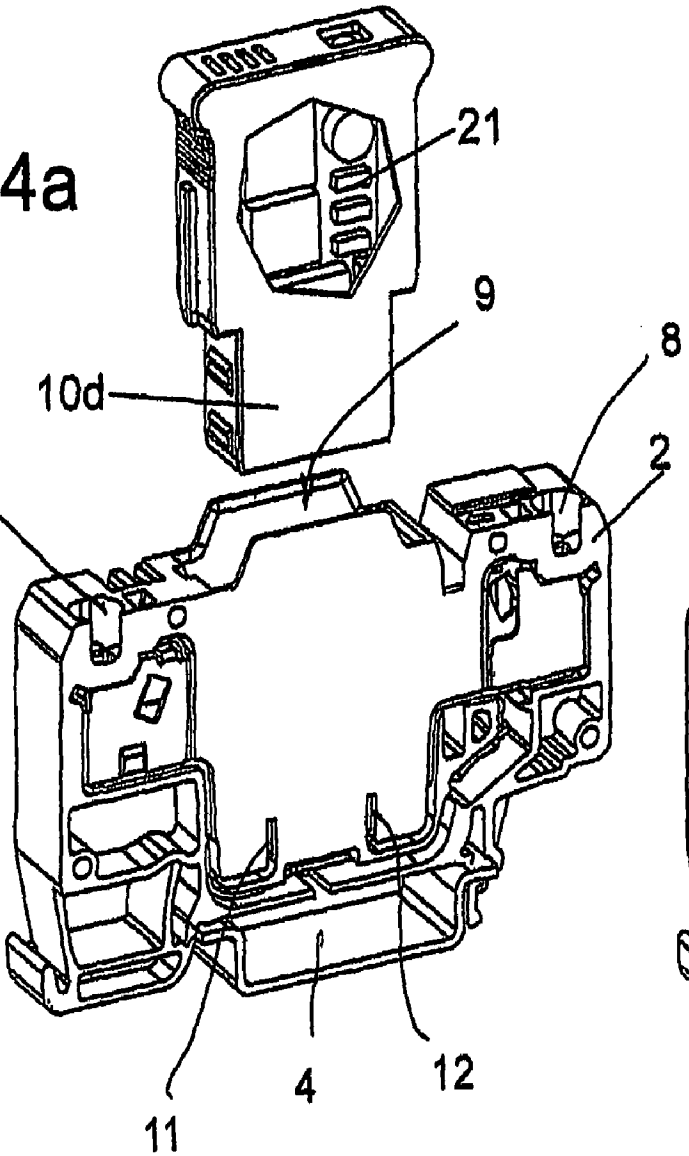

FIGS. 4*a* and 4*b* illustrate a function control module 10*d* that is designed for receiving a plurality of electronic components 21. These electronic components 21, for example, can be made in the form of a printed circuit board with various electronic components. It is also conceivable that one might use a different kind of electronic structure here. For example, design in the form of a relay building block is also conceivable.

Figure 5A:
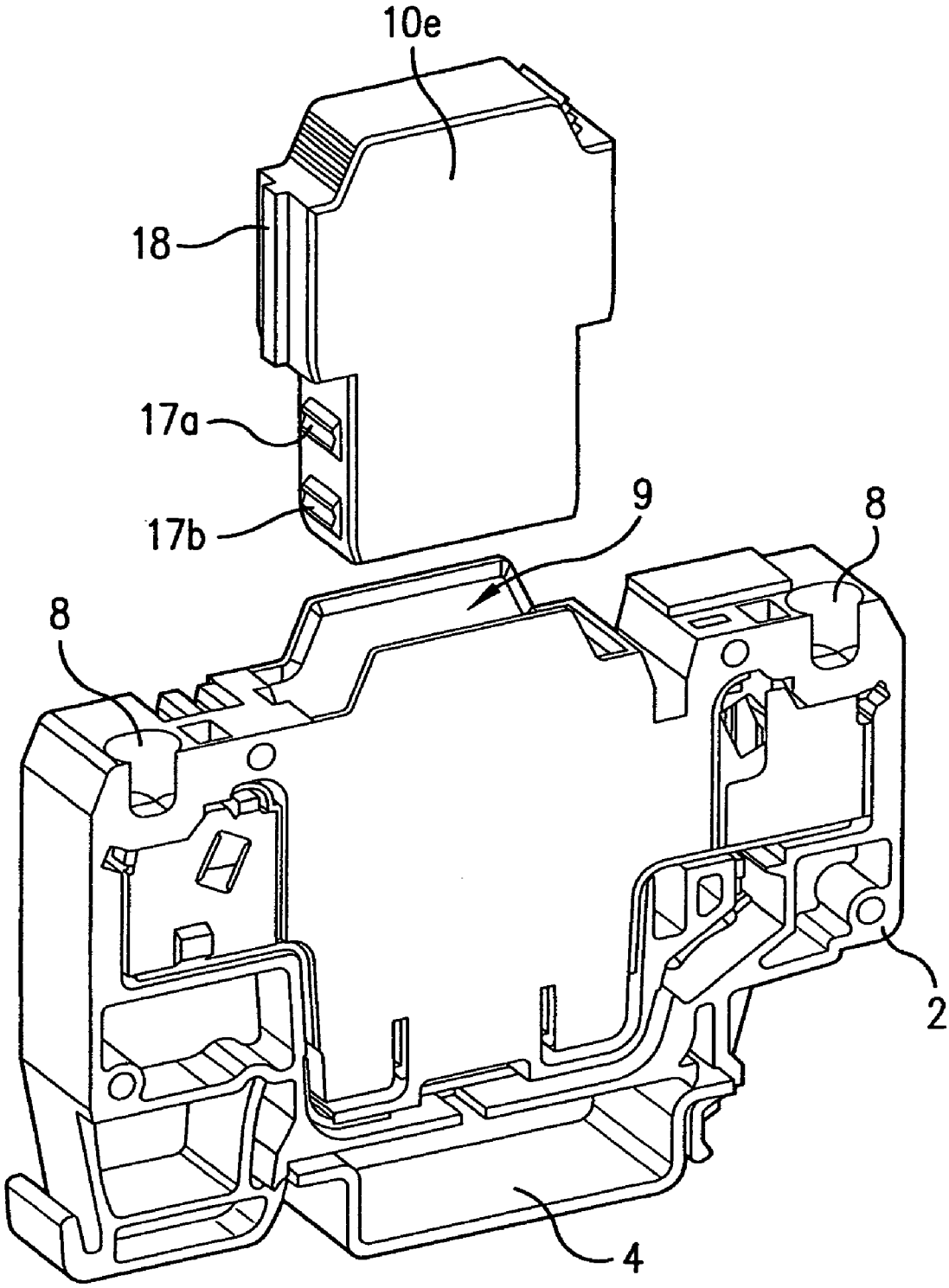
FIGS. 5*a*, 5*b* and 5*c* are perspective views of the universal terminal block with a fifth embodiment of the function control module in the separated, partially inserted and completely inserted positions, respectively.
Figure 5B:
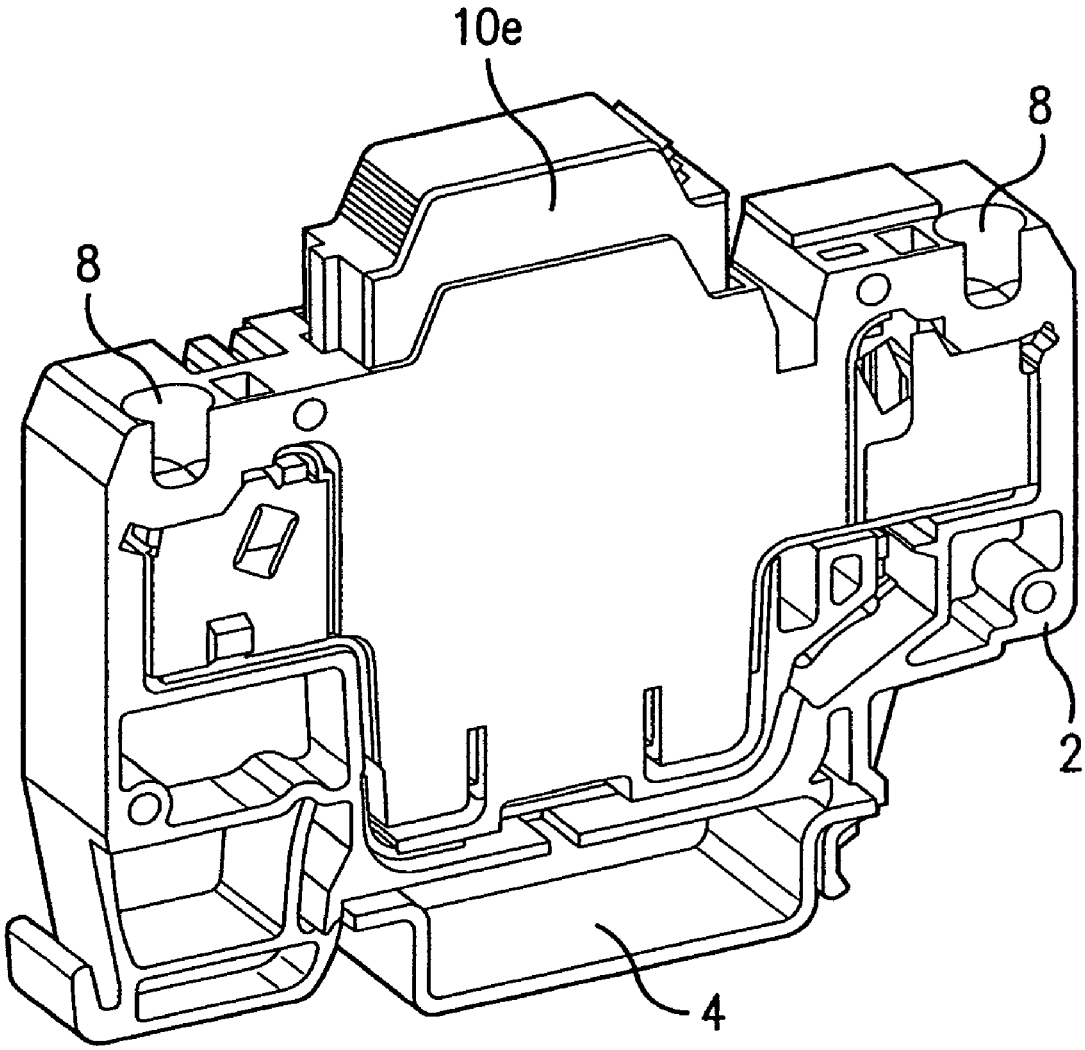
Figure 5C:
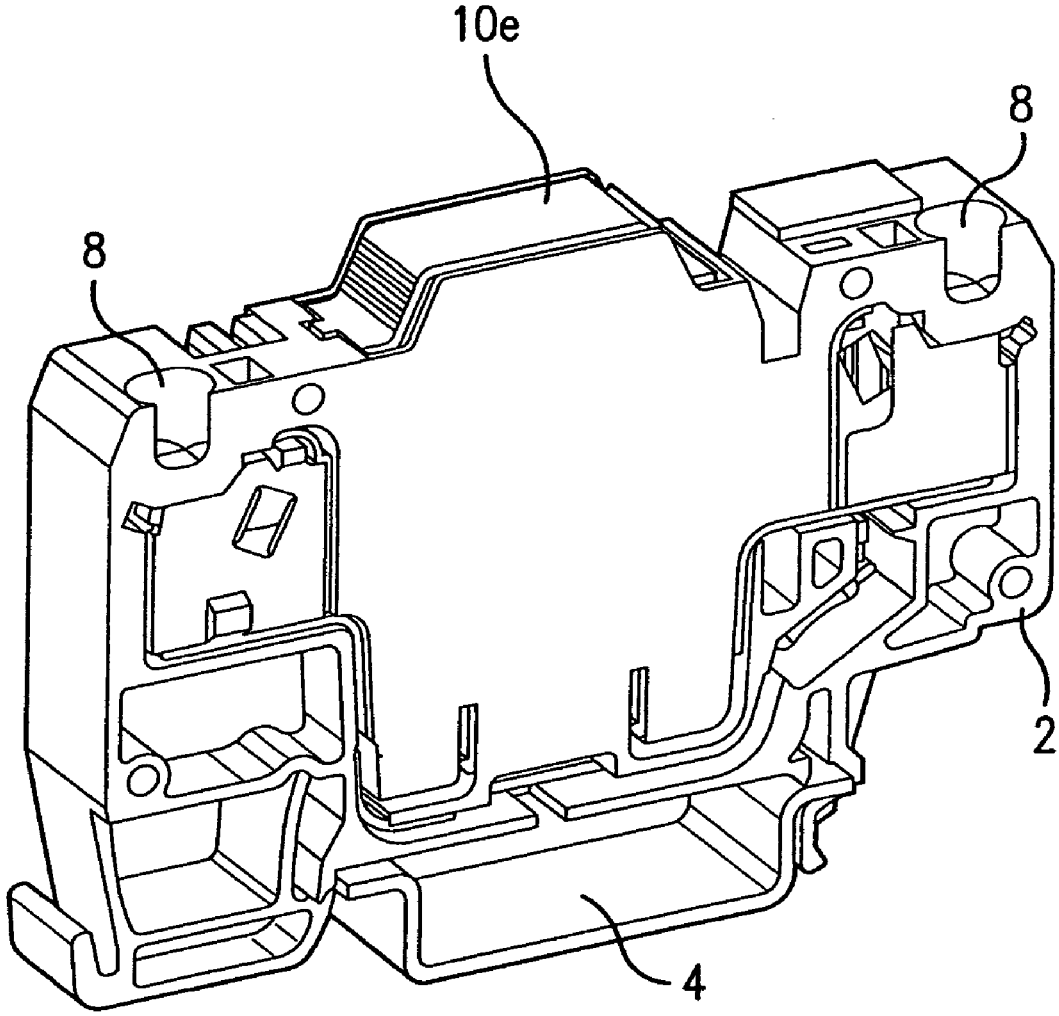

FIGS. 5*a*-5*c* show an exemplary embodiment where the function control module 10*e* is made as a pluggable insert with a separator function so that one comes up with a kind of disconnect terminal. Here in the initial separated state (FIG. 5*a*), there is shown an intermediate position (FIG. 5*b*) and a fully inserted condition (FIG. 5*c*). In FIG. 5*c*, the contacts between function building blocks 10 and the basic body 2 are engaged. In FIG. 5*b*, they are disengaged.

Figure 6A:
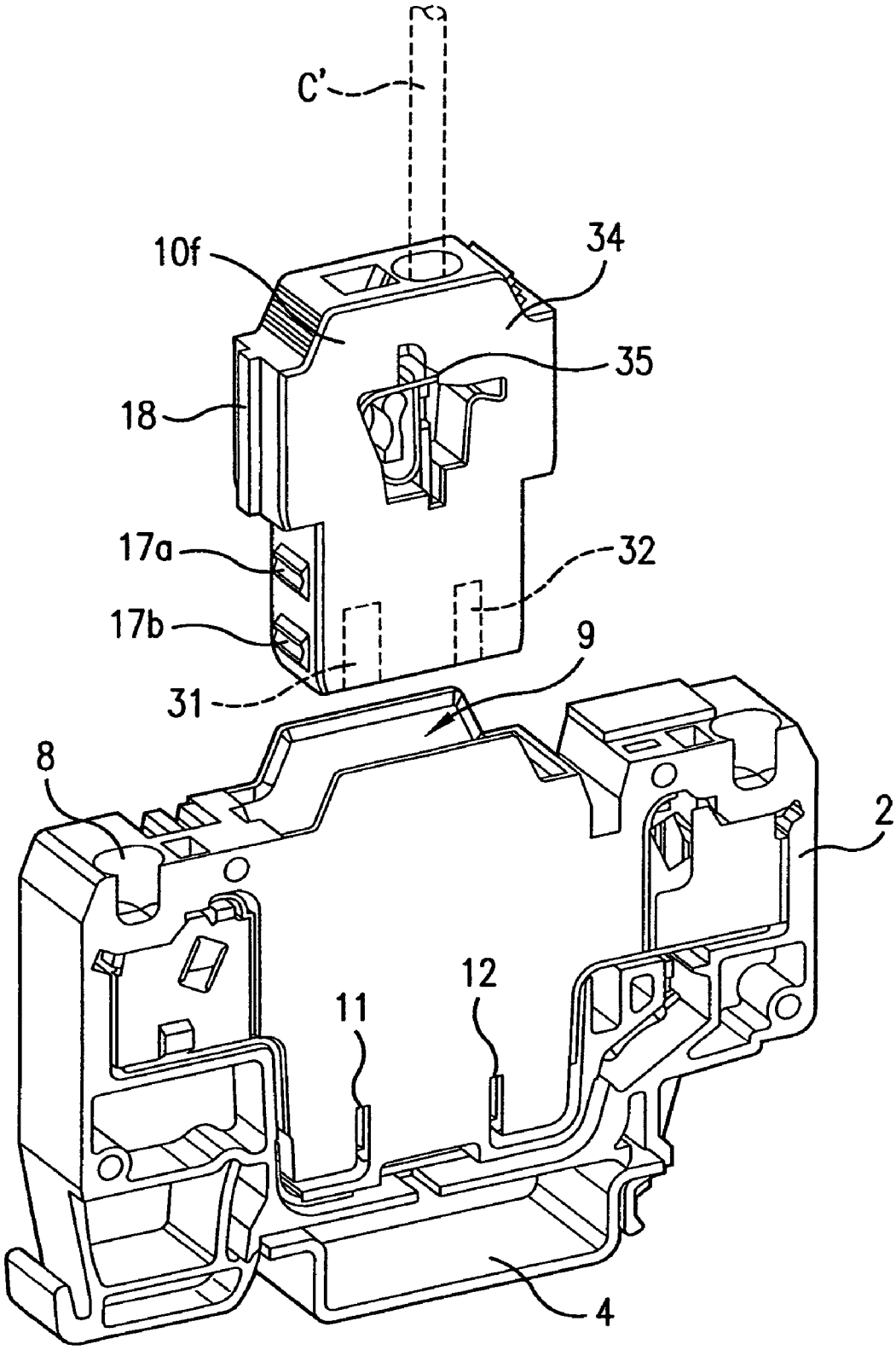
FIGS. 6*a* and 6*b* are perspective views of the universal terminal block with a sixth embodiment of the function control module in the separated and completely inserted positions, respectively.
Figure 6B:
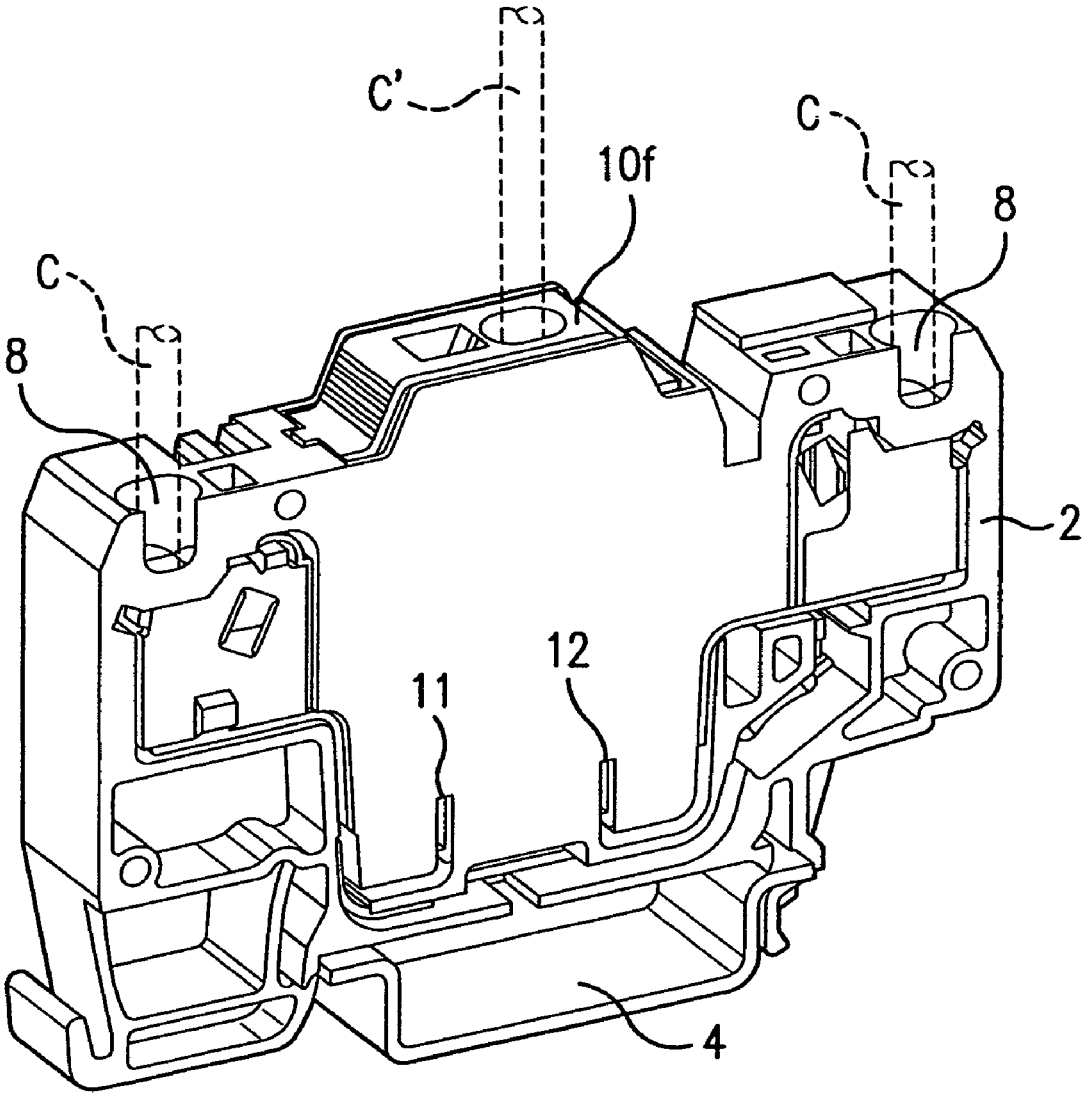

According to FIGS. 6*a* and 6*b*, function control module 10*f* is formed as an additional pluggable connecting terminal that can have its own housing 34 with an additional connection 35 in any desired technique, which, for example, can be made as a tension spring connection with an auxiliary conductor C'. Alternate designs using a push-in technique, a tension spring technique, screw connection, IDC connection and the like are also conceivable.

FIG. 7 presents an overview of the various function control modules 10*a* to 10*f*. Additional function control modules with additional functions—not illustrated here—are conceivable.

It is advantageous when chamber 9 has different catch contours for the purpose of locking of various corresponding catch means of differently shaped function control modules so that function control modules with different external geometry can also be locked in chamber 9 (see, for example, FIGS. 1 and 2).

Figure 8B:
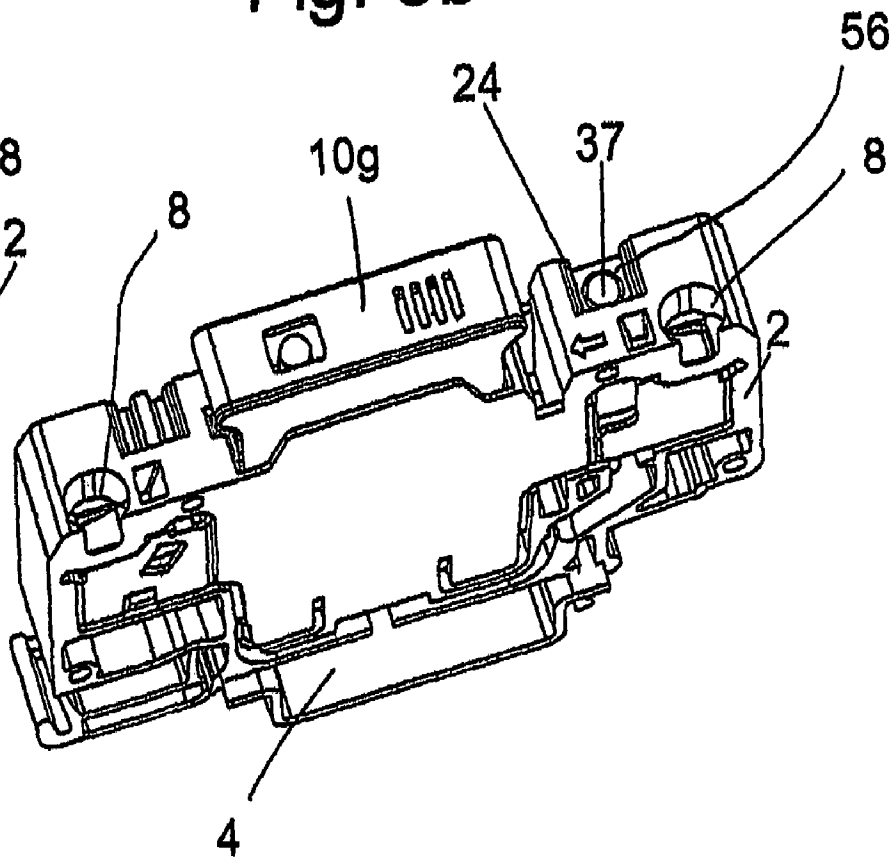
FIGS. 8*a* and 8*b* are perspective views illustrating the universal terminal block having a marker light conducting diode in the uncovered and uncovered conditions, respectively.
Figure 8A:
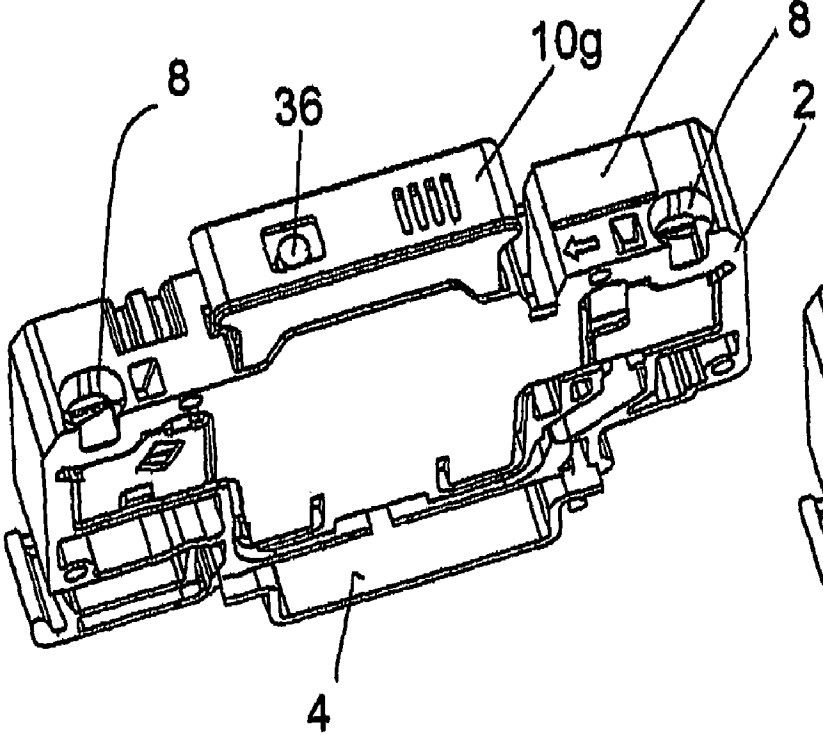

According to FIG. 8*a*, yet another function control modules block 10*g* has a liquid controlled diode (LED), which indicates the state of connection of the components. The LED is labeled 36. A second LED 37 can also be positioned in a marking duct 24 that is arranged in the basic body. The marker can also be made transparent so that one can combine two functions: a label and/or an optical display by means of an LED or a low-voltage glow lamp or the like. This combined function could also be placed upon a safety lever. The function building block and/or basic building block could also be provided with an RFID (Radio Frequency Identification) building block for the transmission of the function state, for example, of the fuse signal state.

Figure 9:
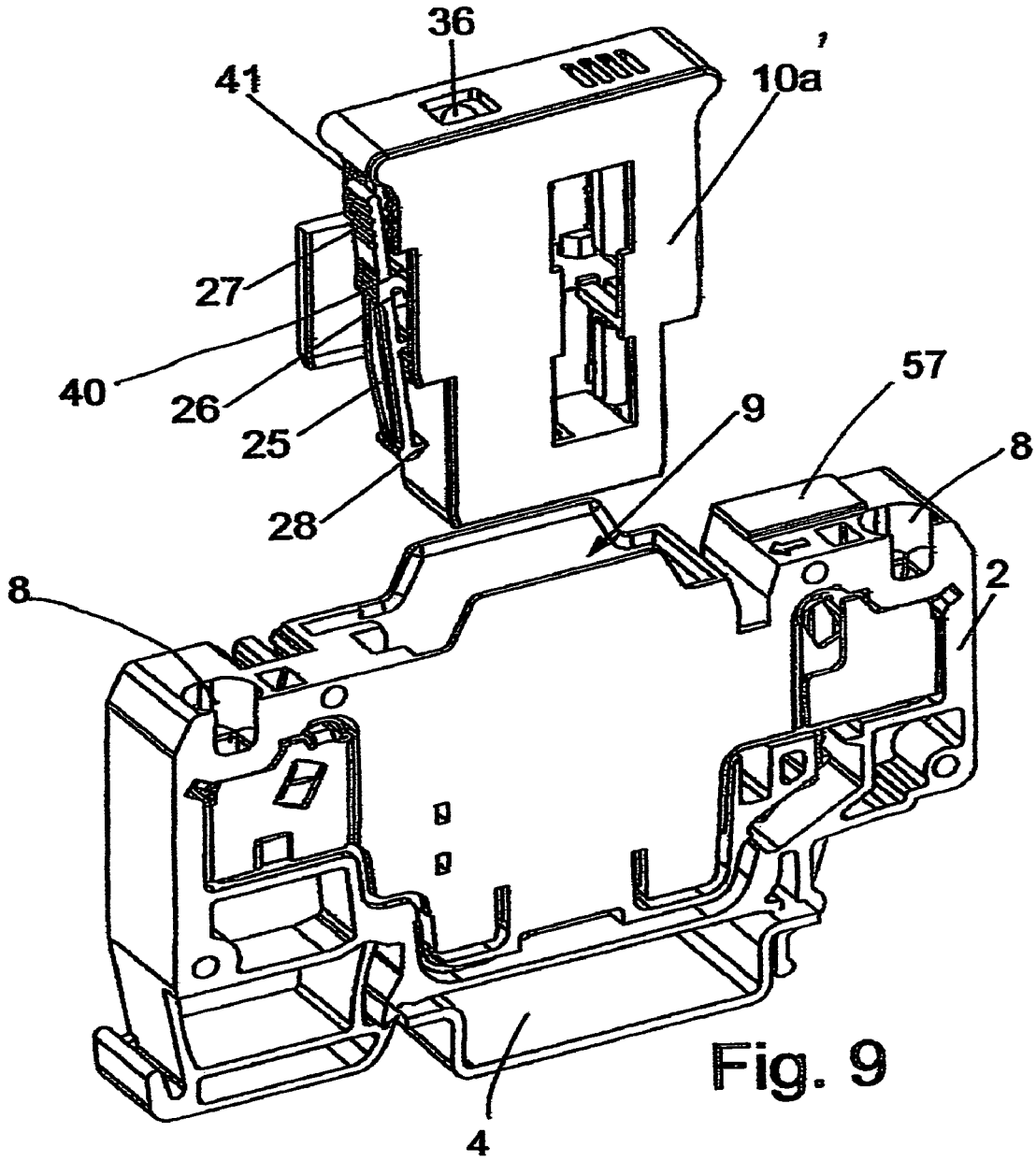
FIG. 9 is an exploded perspective view of a module provided with locking means for locking the module to a universal terminal block.

FIG. 9 shows another variant where function building block 10, for example, the fuse holder 10*a*, is secured against vibrations and the like by a separate (or molded on) locking hook means 25 in chamber 9. The separate locking hook means 25 includes a locking lever 27 having first and second end portions, and an intermediate portion provided with connecting means 26 that extends within a recess 40 contained in function control module 40. The first end portion is provided with a catch hook 28 that is made for grasping behind a corresponding catch edge or catch shoulder 38 on housing base 2 in recess 9 (FIG. 11).

During insertion, catch hook 28 yields and swings in the lowermost position into the undercut 38*a* and thus prevents the loosening of the function building block (FIG. 11*c*). For loosening purposes, one grasps the handle segment 41 at the other end of the locking lever 27, and in that way, one automatically actuates the catch hook 28, and one releases the lock. By means of a shoulder 39 on module housing 10', one can recognize whether the function building block has been inserted far enough into the chamber 9 (if the shoulder of the fuse holder as well as the upper edge of the terminal carrier are on one level, then the fuse holder has reached the correct depth). The movable projection or shoulder 39 on the module housing assures the optical ability to determine as to whether the fuse holder has been stuck in all the way to its working position. That is illustrated in FIGS. 10*a* and 10*b*.

Figure 10A:
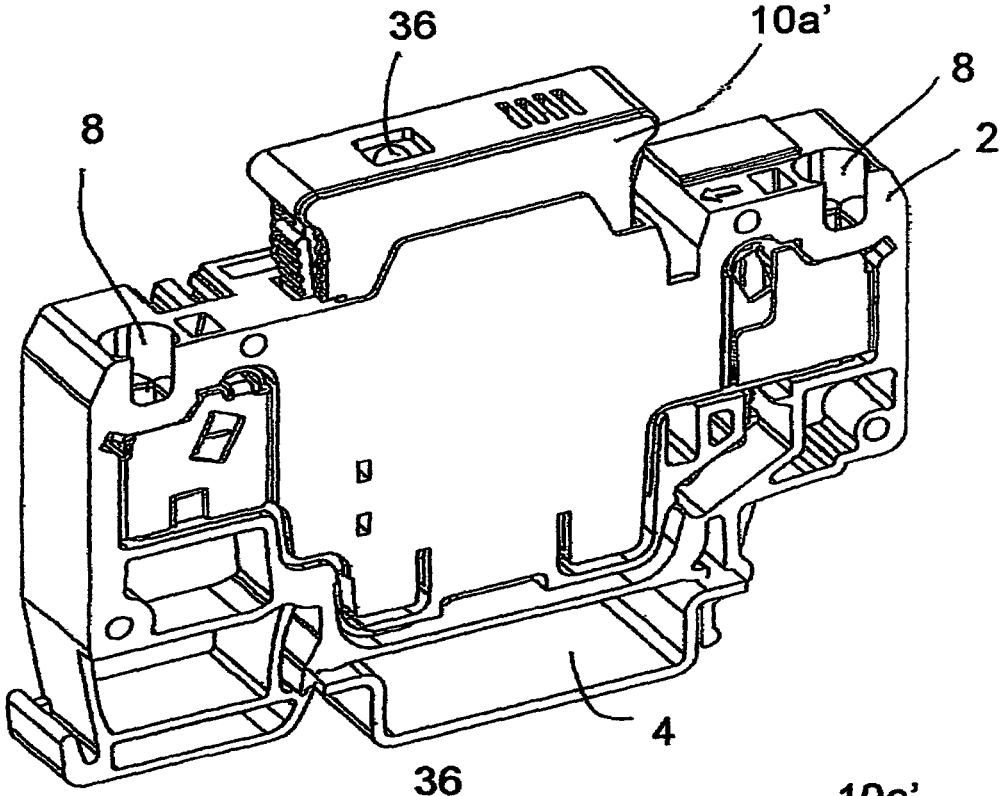
FIGS. 10*a* and 10*b* illustrate the module in FIG. 9 in the partially inserted and completely inserted conditions, respectively.
Figure 10B:
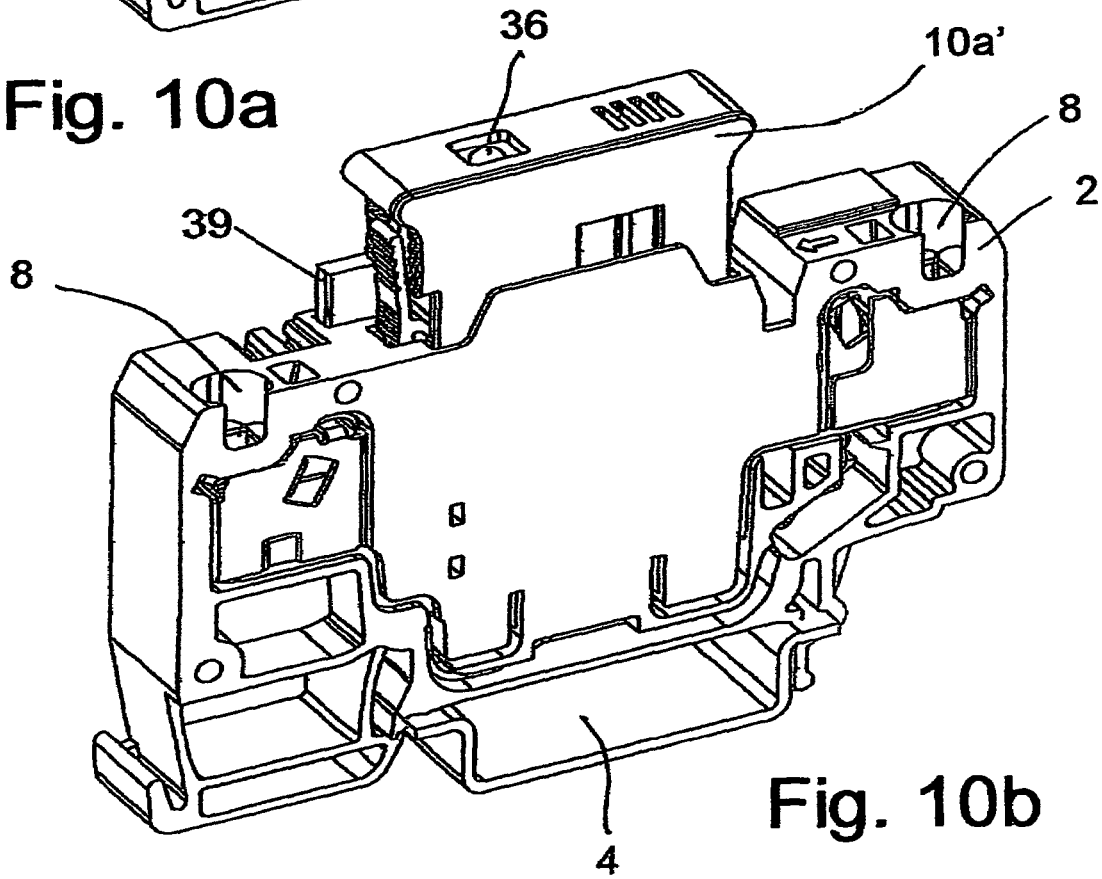
Figure 12A:
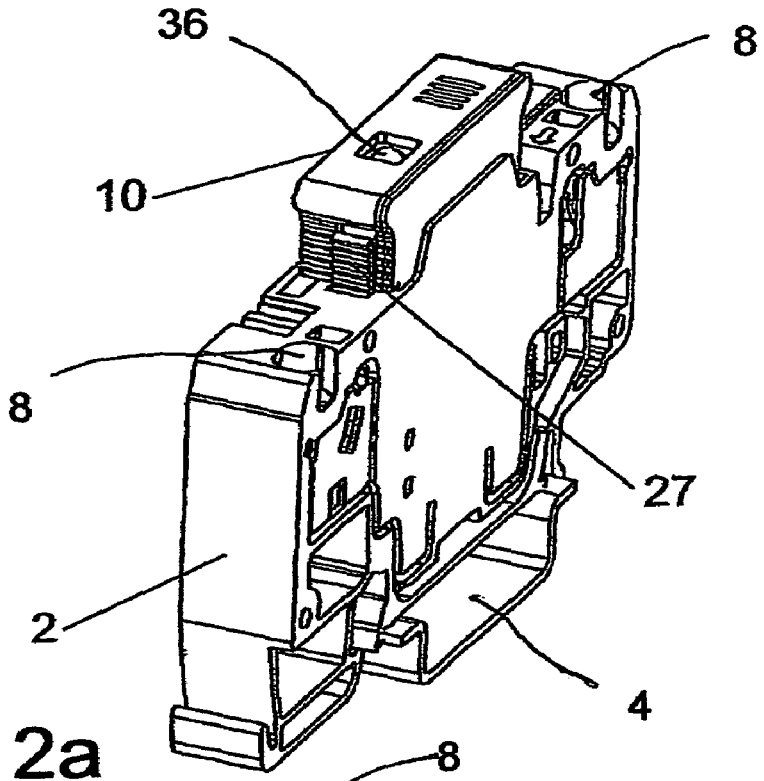
FIGS. 12*a* and 12*b* are perspective views of the apparatus with the locking button in the extended position.
Figure 12B:
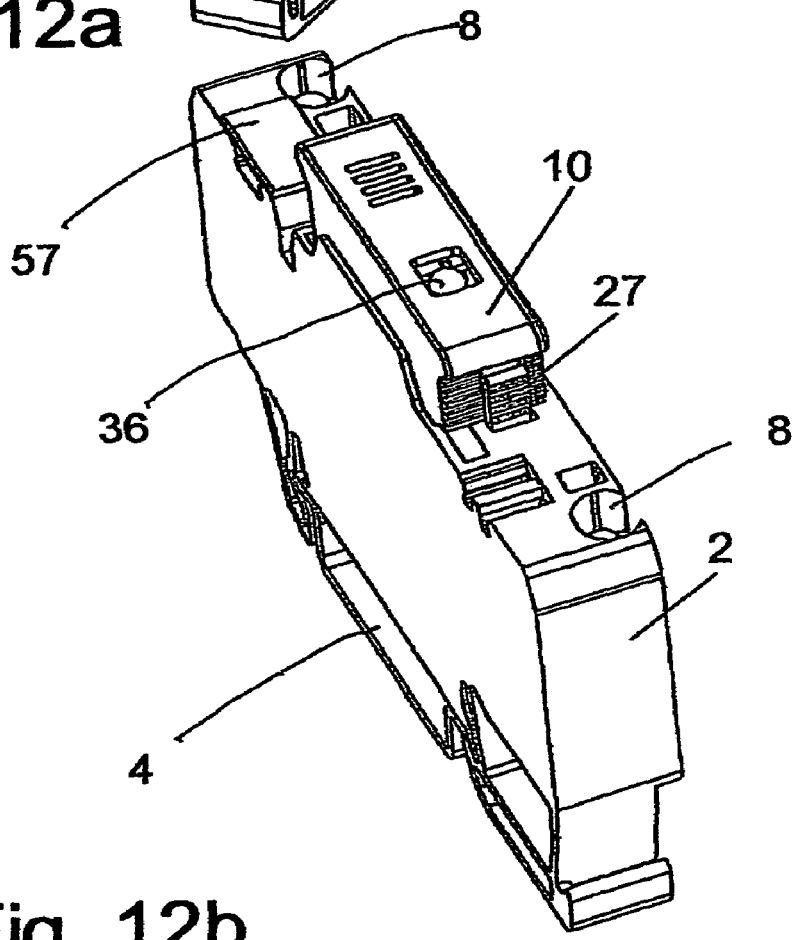
Figure 13A:
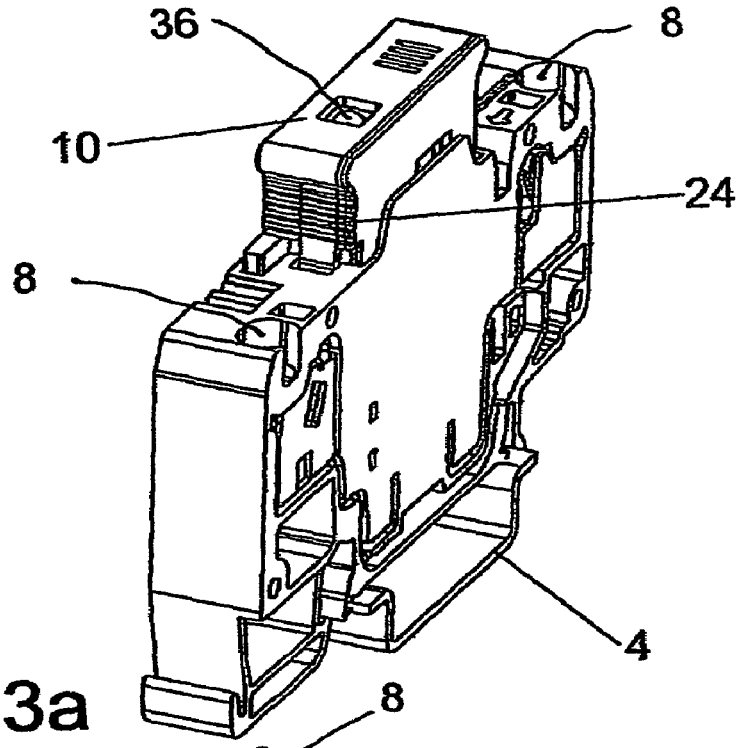
FIGS. 13*a* and 13*b* are perspective views of the apparatus with the locking button in the inserted position.
Figure 13B:
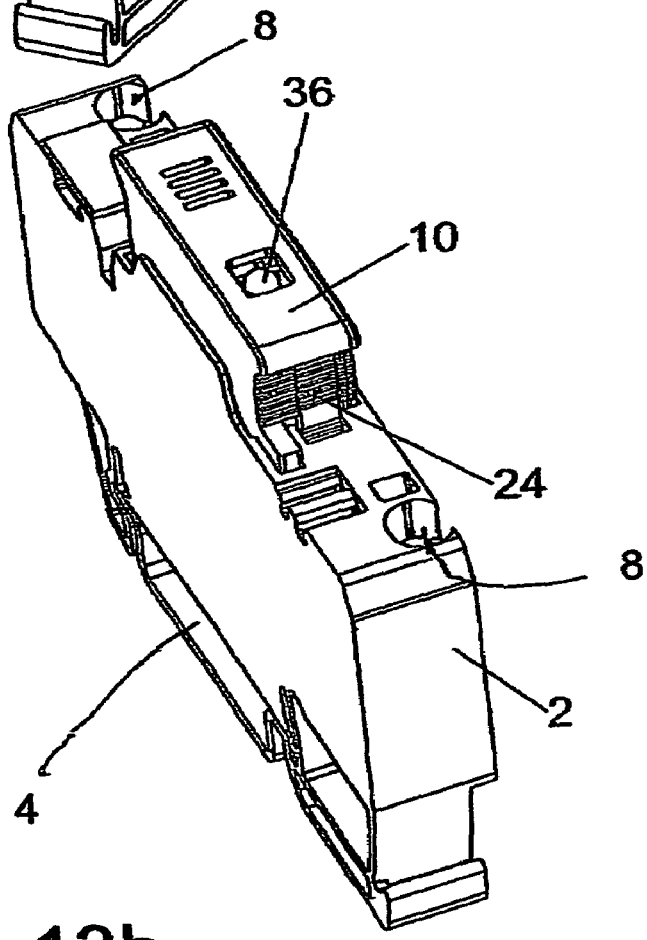

In FIG. 10*a*, the function control module is inserted all the way down to the bottom. Optical recognition is possible here. In the intermediate position shown in FIG. 10*b*, there is no further contact to the basic housing. This function is also retained by the locking hook when there are provided two undercuts 38*a, b* that are offset with respect to each other in the direction of insertion (into the recess 9). The function of the locking hook 25 is visible particularly in FIG. 11, which shows different function positions. Here we can easily recognize the undercuts 38*a* and 38*b*. According to FIG. 11*b*, the undercut is released by actuating the hook and the function control module 10 can be moved upward for removal or for locking into a second upper position. Additional views of these terminals can be seen in FIGS. 12 and 13, wherein the operating button portion is in the extended and inserted positions, respectively.

While in accordance with the provisions of the Patent Statutes the preferred forms and embodiments of the invention have been illustrated and described, it will be apparent to those skilled in the art that changes may be made without deviating from the invention described above.

What is claimed is:

1. A connector arrangement for connecting one of a plurality of plug-in electrical function control modules (10*a*-10*e*) with a pair of insulated electrical conductors (C), comprising:

(a) a universal terminal block (1) including a generally horizontal rectangular body formed of synthetic plastic insulating material, said body including a pair of end portions, and an intermediate portion arranged between said end portions, said intermediate body portion having a horizontal top surface containing a downwardly extending open-topped chamber (9) contained between a pair of vertical side walls (29,30);

(b) a pair of electrical terminals (5, 6) mounted in recesses contained in the end portions of said terminal block body on opposite sides of said chamber for connection with the bare ends of conductors C) respectively introduced downwardly into said recesses via openings (8) contained in said body top surface;

(c) a pair of upwardly-extending stationary electrical contacts (11, 12) mounted in the bottom of said chamber;

(d) bus bar means (13) connecting said contacts with said terminals, respectively;

(e) a plurality of function control modules (10*a*-10*f*) each of which is selectively insertable into said chamber, each of said function control modules including a pair of module contacts (31, 32) arranged for respective electrical engagement with said stationary contacts when said function control module is in a fully inserted condition relative to said chamber;

(f) locking means for normally locking to said universal terminal block body a function control module arranged in said chamber in said fully inserted position, said locking means comprising:

(1) a locking lever (27) having first and second end portions and an intermediate portion:

(2) connecting means (26) connecting said intermediate portion of said locking lever to said function control module so as to permit swinging movement of said locking lever relative to said module:

(3) said connecting lever first end having a catch hook portion (28) biased toward locking engagement with at least one corresponding keeper surface (38*a*) arranged within said terminal block chamber when said function block module is arranged in a fully inserted position in said chamber; and (g) manually operable release means for releasing catch hook portion from said keeper surface, thereby to permit removal of said function control module from said chamber, said release means including an operating tab portion (41) arranged at the other end of said locking lever.

2. A connector arrangement as defined in claim 1, wherein said module has a stepped configuration defining at least one first support shoulder, and further wherein said terminal block body includes at least one second support arranged for engagement by said first support shoulder when said module is in said fully inserted position.

3. A connector arrangement as defined in claim 1, wherein said module contains a lateral fuse recess (15), said module including an electrical circuit having a fuse (16) mounted in said lateral recess.

4. A connector arrangement as defined in claim 3, wherein different ones of said function control modules contain fuse recesses of different lengths for receiving fuses of correspond different lengths, respectively.

5. A connector arrangement as defined in claim 1, wherein said locking means further includes:

(4) positioning means (38*b*) for locking said module (10) at a partially-inserted intermediate position in said chamber.

6. A connector arrangement as for connecting one of a plurality of plug-in electrical function control modules (10*a*-10*e*) with a pair of insulated electrical conductors (C), comprising:

(a) a universal terminal block (1) including a generally horizontal rectangular body formed of synthetic plastic insulating material, said body including a pair of end portions, and an intermediate portion arranged between said end portions, said intermediate body portion having a horizontal top surface containing a downwardly extending open-topped chamber (9) contained between a pair of vertical side walls (29,30):

(b) a pair of electrical terminals (5,6) mounted in recesses contained in the end portions of said terminal block body on opposite sides of said chamber for connection with the bare ends of conductors C) respectively introduced downwardly into said recesses via openings (8) contained in said body top surface;

(c) a pair of upwardly-extending stationary electrical contacts (11, 12) mounted in the bottom of said chamber;

(d) bus bar means (13) connecting said contacts with said terminals, respectively;

(e) a plurality of function control modules (10*a*-10*f*) each of which is selectively insertable into said chamber, each of said function control modules including a pair of module contacts (31,32) arranged for respective electrical engagement with said stationary contacts when said function control module is in a fully inserted condition relative to said chamber; and (f) means for indicating the state of connection between each of said function control modules and said terminal block, said indicating means comprising at least one first light emitting diode (36) connected with one of said module contacts.

7. A connector arrangement as defined in claim 6, wherein said terminal block body supports at least one second light emitting diode (37) connected with one of said terminals.

8. A connector arrangement as defined in claim 7 wherein said second light emitting diode is mounted in a marker recess (56) contained in said body top surface; and further including a marker cover member (57) formed of transparent material mounted in said marker recess above said second light emitting diode.

9. A connector arrangement for connecting one of a plurality of plug-in electrical function control modules (10*a*-10*e*) with a pair of insulated electrical conductors (C), comprising:

(a) a universal terminal block (1) including a generally horizontal rectangular body formed of synthetic plastic insulating material, said body including a pair of end portions, and an intermediate portion arranged between said end portions, said intermediate body portion having a horizontal top surface containing a downwardly extending open-topped chamber (9) contained between a pair of vertical side walls (29,30);

(b) a pair of electrical terminals (5, 6) mounted in recesses contained in the end portions of said terminal block body on opposite sides of said chamber for connection with the bare ends of conductors C) respectively introduced downwardly into said recesses via openings (8) contained in said body top surface;

(c) a pair of upwardly-extending stationary electrical contacts (11, 12) mounted in the bottom of said chamber;

(d) bus bar means (13) connecting said contacts with said terminals, respectively;

(e) at least one function control module (10) including a pair of module contacts (31, 32) arranged for respective electrical engagement with said stationary contacts when said function control module is in a fully inserted condition relative to said chamber; and (f) means for indicating the state of insertion of said function control module into said chamber, comprising a lateral shoulder (39) integral with said control module, said integral shoulder being so arranged that when said module is in said completely inserted position relative to said chamber, the upper surface of said integral shoulder is level with the adjacent upper surface of said terminal block.

* * * * *